US007764869B2

(12) United States Patent
Noe et al.

(10) Patent No.: US 7,764,869 B2
(45) Date of Patent: Jul. 27, 2010

(54) HEATER APPARATUS

(75) Inventors: Nathan Harrison Noe, Calabasas, CA (US); David A. Boyd, Pasadena, CA (US)

(73) Assignee: Lexington Environmental Technologies, Inc., Mesa, AZ (US)

( * ) Notice: Subject to any disclaimer, the term of this patent is extended or adjusted under 35 U.S.C. 154(b) by 916 days.

(21) Appl. No.: 11/420,187

(22) Filed: May 24, 2006

(65) Prior Publication Data

US 2006/0266803 A1 Nov. 30, 2006

Related U.S. Application Data

(60) Provisional application No. 60/684,919, filed on May 25, 2005.

(51) Int. Cl.
*H05B 3/60* (2006.01)
*H05B 6/62* (2006.01)

(52) U.S. Cl. ..... 392/322; 219/772

(58) Field of Classification Search ..... 392/311–323, 392/400–464; 137/334; 99/279–323.3; 122/13.01–19.2; 219/772, 764–780

See application file for complete search history.

(56) References Cited

U.S. PATENT DOCUMENTS

| | | | | |
|---|---|---|---|---|
| 3,641,302 | A | 2/1972 | Sargeant | |
| 5,110,418 | A * | 5/1992 | Garrison et al. | 202/181 |
| 5,506,391 | A | 4/1996 | Burayez et al. | |
| 5,511,388 | A * | 4/1996 | Taylor et al. | 62/389 |
| 6,390,027 | B1 * | 5/2002 | Lyons et al. | 122/14.2 |
| 6,688,329 | B2 * | 2/2004 | Murray et al. | 137/392 |
| 2001/0045820 | A1 | 11/2001 | Kean et al. | |
| 2005/0224016 | A1 * | 10/2005 | Kemp et al. | 122/14.2 |
| 2009/0074389 | A1 * | 3/2009 | Noe et al. | 392/314 |

* cited by examiner

*Primary Examiner*—Daniel Robinson
(74) *Attorney, Agent, or Firm*—Kelly Lowry & Kelley, LLP

(57) ABSTRACT

Electrical oscillations are supplied to electrodes of a diathermal heating chamber. A liquid is passed through the diathermal heating chamber so as to be heated. The liquid has a minimum level of dissolved solids, which is replenished over time or when the dissolved solids in the liquid fall below a predetermined minimum level. Alternatively, when the level of dissolved solids is excessive, current input or liquid temperature is reduced.

27 Claims, 3 Drawing Sheets

HEATER APPARATUS

BACKGROUND OF THE INVENTION

The present invention generally relates to heaters. More particularly, the present invention relates to a method for heating a liquid using a diathermal liquid heater using electrical oscillations to rapidly heat the liquid to high temperatures. The present invention does so by monitoring the level of dissolved solids in the liquid, and replenishing the dissolved solids when they fall below a predetermined minimum level.

Heating systems are commonly employed to provide occupants of a building suitable living and working temperatures. Several forms of heaters are known, including for example, resistive electric heat, natural gas furnaces, oil furnaces and the like. In some instances, heated air is then pumped through the building. In other instances, hydronic heating systems are used. In such systems, water is typically heated by an oil or natural gas furnace and the water is pumped through a closed system, typically within the floor of the building or area to be heated. Not only the floor, but also a space above the floor is heated by radiant heat emitted from the heated water running in the closed loop system below the floor.

These heating systems have their disadvantages. They typically require either a fairly large amount of electricity, or the burning of fossil fuels which can be expensive and also which emit undesirable byproducts. Hydronic heating systems generally rely on a central hot water supply and insulation of pipes, which adds construction expenses. Such hydronic heating systems typically share the home plumbing hot water supply, and can deplete the water available for showers and other applications.

Diathermal heating devices are known. For example, U.S. Pat. No. 3,641,302 to Sargeant discloses an apparatus for treating liquids with high-frequency electrical energy. Sargeant discloses that the high-frequency electrical energy or field pervades and fills all the space between electrodes, hence the liquid is subjected to the action of this energy once it passes between the electrodes causing it to be heated. More recently, U.S. Pat. No. 5,506,391 to Burayez et al. disclose a liquid heater using electrical oscillations. Similar to Sargeant, Burayez et al. disclose that the electrical oscillations, and not the passage of current, are used to generate the heat. Burayez et al. teach the use of a control circuit for controlling the source and amplitude of the electrical oscillations used to heat the water. The power supply is modulated by an oscillator circuit connected to a thermal sensor. A microprocessor takes the thermal readings and controls the modulated power supply.

However, the inventor has discovered that, in fact, the level or modulation of the oscillations is not critical to the performance of the diathermal heater. Instead, it has been discovered that the heat produced by the diathermal heater is directly related to the amount of current input into the heater. The amount of current that can be input into the heater, it has been determined, is based largely on the level of dissolved solids, in the form of dissolved mineral salts, present in the liquid. Accordingly, there is a need for a diathermal heater wherein the level of dissolved solids is periodically replenished so as not to fall below a predetermined minimum level such that the diathermal heater can operate efficiently. The present invention fulfills these needs and provides other related advantages.

SUMMARY OF THE INVENTION

The present invention resides in a method for heating a liquid using a diathermal heating chamber having spaced apart electrodes. A liquid, typically water, having a predetermined minimum level of dissolved solids is passed through the space between the electrodes within the diathermal heating chamber. The diathermal heating chamber may have concentric electrodes, parallel electrodes, an alternating array of electrodes, or other arrangement of electrodes.

Electrical oscillations are supplied to the electrodes. Typically, the electrical oscillations are supplied at a generally constant level. For example, 100 to 500 volts of electricity at approximately 60 Hz is typically supplied to the electrodes.

Over time, the dissolved solids in the liquid are depleted. Thus, the dissolved solids are replenished so that the level thereof does not fall below a predetermined minimum level. The level of dissolved solids and liquid can be monitored and replenished in a variety of ways. The level of dissolved solids in the liquid may be directly sensed or measured. Alternatively, the electrical current of the oscillation input into the electrodes is monitored. When the electrical current input to the electrodes falls below a predetermined threshold level, the dissolved solids are replenished. Alternatively, or in addition to, the temperature of the liquid may be measured and monitored. When the liquid temperature falls below a predetermined threshold level, the dissolved solids are replenished. In yet another embodiment, the dissolved solids may be replenished after the liquid has been heated by the heater for a predetermined period of time. The dissolved solids may be replenished by injecting a concentrate of the dissolved solids, or solids to be dissolved into the liquid. Alternatively, at least a portion of the liquid may be replaced with liquid having a minimum level of dissolved solids.

In one embodiment of the present invention, the heated liquid is pumped through a heat exchanger device so as to transfer heat from the liquid to another fluid, such as air. The temperature of the heated fluid can be monitored, and when it falls below a predetermined level, the dissolved solids within the heater may be replenished.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a method for heating a liquid utilizing a diathermal heating system. In accordance with the present invention, as will be described more fully herein, the present invention resides in the control of a series of non-equilibrium, exothermic, electrochemical reactions catalyzed by minerals in the liquid, typically water. The level of dissolved solids or minerals in the liquid is monitored, directly or indirectly, and adjusted as needed in order to attain the heat output desired and maintain the system at an acceptable level of efficiency.

Figure 1:
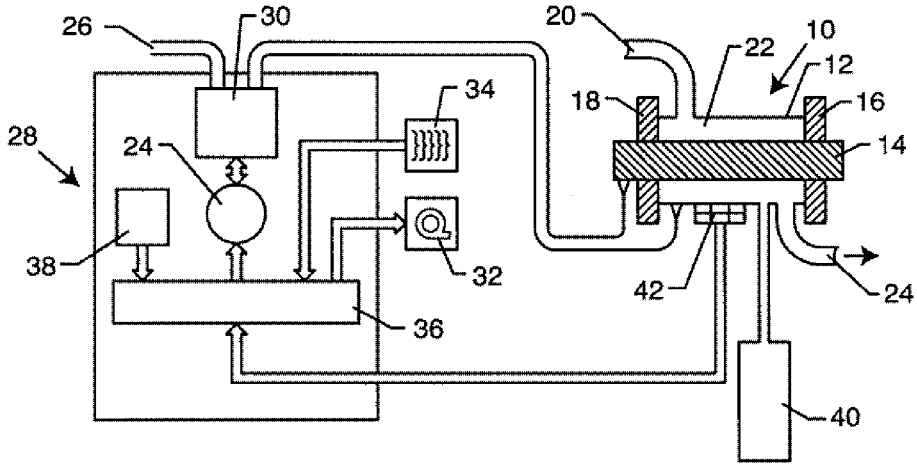
FIG. 1 is a diagrammatic view of a diathermal heater, used in accordance with the present invention.

With reference now to FIG. 1, a diathermal heating chamber 10 includes spaced apart electrodes 12 and 14. In the embodiment illustrated in FIG. 1, the electrode 12 comprises an outer cylindrical conductive tube, and the inner electrode 14 comprises an inner metal conductive tube. Insulation spacers 16 and 18 electrically isolate the electrodes 12 and 14 from one another, and serve to seal the heating chamber 10 so that a liquid can pass therethrough. The liquid, typically an aqueous solution, such as water containing dissolved minerals, enters the heater chamber 10 through inlet 20, passes in the space 22 between the electrodes 12 and 14 before exiting outlet 24. Electrical oscillations and current provided to the electrodes 12 and 14 heat the liquid, as will be discussed more fully herein.

With continuing reference to FIG. 1, power typically passes through an electronic control circuit and/or electrical components before being supplied to the electrodes 12 and 14 of the heating chamber. In one embodiment, as illustrated in FIG. 1, the power source 26 comprises an alternating current source of power, such as that supplied by household, commercial, or generator supplied power sources. In the present invention, instead of controlling and altering the electrical oscillations (as disclosed in U.S. Pat. No. 5,506,391), a generally constant level of electrical oscillations is supplied to the electrodes. This is typically between 100 and 500 volts of approximately 60 Hz. Of course, the voltage, current and Hertz or oscillations depends upon the source of the power 26. In many instances, the power will be provided via a wall outlet, and as such will be either 110 volts or 220 volts at 60 Hz. However, the frequency and voltage of the power supply is not critical to the operation of the present invention.

The control circuit 28 typically includes a power input controller 30 such that the amount of power supplied to the diathermal heater 10 can be adjusted and controlled. In this manner, to some extent, the degree of heating of the liquid passing through the heating chamber 10 is controlled and adjusted. A pump 32 may be used to pass the liquid through the heating chamber 10. This is particularly the case in a closed loop system wherein a source of liquid, such as a tank of liquid, is recirculated through the system and diathermal heating chamber 10. If the system is a pass-through system, such as would be used as a water heater, steam generator, etc., the existing water or liquid pressure may be sufficient so as to obviate the need for the pump 32. In such a case, a flow sensor 34 could be used to measure the flow of liquid passing through the heating chamber 10, and in place of a pump 32, restrictor valves could be implemented to adjust the flow of liquid passing therethrough. Such could be controlled, for example, by a microprocessor 36 coupled to a memory device 38. It will be appreciated by those skilled in the art that the flow sensor 34, microprocessor 36, and memory device 38 are optional and not necessarily required for the operation of the present invention.

The inventors have discovered that dissolved solids, such as minerals and other impurities in the liquid, are susceptible to electrical oscillations and cause the liquid to heat rapidly so that the liquid is hot as it emerges from the heating chamber 10. Liquid having a very low dissolved mineral content does not heat efficiently. For example, when distilled water is passed through the heating chamber 10, it is very difficult to heat the distilled water. However, when water is passed through the heating chamber 10 which has a relatively high dissolved mineral content, the water can be heated very efficiently and to fairly high temperatures.

Tests have been conducted in order to confirm this phenomena. A closed-loop system holding 26 ounces of fluid, water having dissolved minerals or solids therein, has been passed through the heating chamber 10 using alternating current power supplied from a wall outlet and run for 80 minutes. The input power had a voltage of 220 volts, providing approximately 32 amps. The water was analyzed before being heated for 80 minutes, and after being heated for 80 minutes, as shown in Table 1.

TABLE 1

Dissolved Elements (mg/l) using SS electrodes

| Element | After | Before |
|---|---|---|
| Calcium | 21 | 30 |
| Chromium | 1.0 | <0.05 |
| Copper | 1.6 | <0.05 |
| Iron | 12 | <0.05 |
| Lead | 0.33 | <0.005 |
| Magnesium | 11 | 16 |
| Manganese | 0.50 | <0.05 |
| Molybdenum | 0.064 | <0.05 |
| Nickel | 1.9 | <0.05 |
| Zinc | 0.40 | <0.05 |

Stainless steel (SS) electrodes were used in a configuration similar to that shown in FIG. 1. After 80 minutes of operation, the levels of Ca and Mg were reduced by approximately 30%, and there was an increase in metals associated with the stainless steel electrodes, namely, Fe, Cr, Ni, and Mn. The pH of the solution increased from 8.8 to 9.3, and the conductance decreased from 510 to 460 microsemens. It is believed that the driving mechanism for the excess heat is created by a series of non-equilibrium, exothermic, chemical reactions which take place on the electrodes. It is believed that the mineral compounds (herein referred to as dissolved solids) in the water or other liquid and the electrode material react to form metal hydroxides. The formation of metal hydroxides is supported by the increase in pH.

This experiment was repeated, but using iron electrodes instead of the stainless steel electrodes. The before and after measured dissolved elements in the water are shown in Table 2.

TABLE 2

Dissolved Elements (mg/l) using iron electrodes.

| Element | After | Before |
|---|---|---|
| Calcium | 18 | 30 |
| Chromium | <0.05 | <0.05 |
| Copper | <0.05 | <0.05 |

TABLE 2-continued

Dissolved Elements (mg/l) using iron electrodes.

| Element | After | Before |
|---|---|---|
| Iron | 0.13 | <0.05 |
| Lead | 0.15 | <0.005 |
| Magnesium | 8.1 | 16 |
| Manganese | 0.50 | <0.05 |
| Molybdenum | <0.05 | <0.05 |
| Nickel | <0.05 | <0.05 |
| Zinc | 0.070 | <0.05 |

Once again, the dissolved solid minerals (calcium and magnesium) were depleted significantly, by 40% to 50%. An increase in the metals associated with the electrodes also increased. In this case, the amount of iron and lead increased significantly, but the levels of chromium and other heavy metals associated with the 304 stainless steel electrodes remained the same.

With the mineral content of the water used in the experiments, the 62 ounces of water will last approximately 60 hours before a depreciable effect in the heating effect occurs. However, minimal corrosion has been observed for electrodes that have been used for hundreds of hours of operation. Thus, it has been determined that the levels of dissolved solids, such as mineral salts in the water or other liquid plays a critical role in the efficiency and heat output of the heating chamber 10.

Thus, in order to maintain an optimum efficiency, or even an adequate efficiency, and heat output, the level of dissolved solids and minerals in the liquid must be periodically replenished. FIG. 1 illustrates a source of dissolved solids 40 which can be directly injected into the heating chamber 10, an inlet pipe leading to the heater chamber 10, or a source of the liquid to be circulated through the heater chamber 10. Even in a flow through embodiment, dissolved minerals 40 may need to be added to the liquid. For example, in the United States, there are certain areas of the country where the dissolved mineral content of the water is sufficiently high that it can be adequately heated by passing it through the heating chamber 10 of the present invention. However, in other areas of the country, the water is relatively "soft", and in order to increase the heat output and efficiency of the heater 10, minerals and dissolved solids should be added to the water before it enters into the heater chamber 10. Moreover, in closed loop systems, as discussed above, the amount of dissolved minerals is depleted over time. Thus, the dissolved solids must periodically be replenished, even if the original level of dissolved minerals in the liquid was sufficiently high. This can be done in a different number of ways. For example, if the water is sufficiently "hard" or has a relatively high mineral content, in a closed loop system, at least a portion of the depleted water can be replenished with fresh "hard" water. This can be done periodically, such as at predetermined hours of operation, such as after 60 hours of operation. Other methods of replenishing the dissolved solids include supplying solid salts into the liquid, which are then dissolved by the liquid and replenish the levels of minerals and dissolved solids within the liquid. Alternatively, a source of concentrated dissolved minerals can be periodically injected into the liquid. These latter two methods can be used in both closed loop as well as flow through embodiments.

Although the dissolved solids can be added according to time of operation, other methods of monitoring the level of dissolved solids and maintaining the level of dissolved solids at a predetermined minimum level are also possible. For example, sensors may be used to monitor the mineral content of the liquid. When the mineral content falls below a predetermined minimum level, the dissolved solids are replenished.

It has been found that the temperature of the water in the heating chamber 10, or even upstream thereof, can also be used to determine and monitor the level of dissolved solids. Thus, a thermal sensor 42 can be used to monitor the temperature of the liquid. The thermal sensor 42 is illustrated as being coupled directly to the heating chamber 10 in FIG. 1. However, it will be appreciated that such thermal sensors can also be placed upstream of the heating chamber 10, or it can even be implemented as a thermostat measuring the temperature of a secondary fluid heated by the liquid passed through the heating chamber 10, such as the temperature of air emitted from the system. When the temperature begins to fall to a predetermined level, the amount of dissolved solids in the liquid is replenished.

Alternatively, or in addition to such a method of monitoring, a power comparator 44 can be used to measure and compare the amount of power supplied to the electrodes 12 and 14. It has been found that when a sufficiently high level of dissolved solids are within the liquid, the liquid pulls in a higher level of current than when the level of dissolved solids is lower. Thus, the amount of current provided to the system can be monitored, and when it falls below a determined level, the amount of dissolved solids in the liquid can be replenished, resulting in the amount of current supplied to the system increasing. In fact, a combination of monitoring the temperature of the water and the power provided to the system can be used to monitor the level of dissolved solids in the liquid and determine when such dissolved solids need to be replenished.

Although the dissolved solid content in the aqueous solution must usually either be raised or replenished, there are instances when the dissolved mineral content within the water or other solution is too high. In such instance, the system will naturally pull in a large amount of current and heat the water to a very high temperature. In such cases, this is controlled in a variety of ways. For example, the control circuit 28 can include a current limiter such that the amount of power, more particularly current, that is input into the electrodes 12 and 14 is limited. In another embodiment, the temperature of the liquid is monitored, and the power input into the system is shut off when the temperature of the liquid exceeds a predetermined level. The liquid can also be cooled, such as by using fans or the like, to control the heating process. Such steps may be required when the dissolved solid content of the aqueous solution is too high, such as very hard water or adding too much salt or concentrated dissolved minerals or the like occurs.

Figure 2:
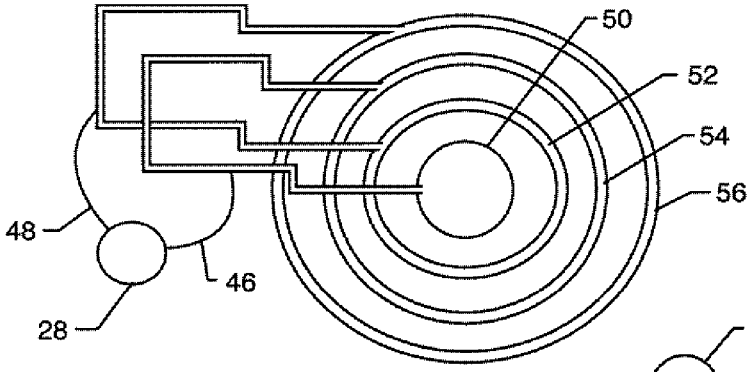
FIG. 2 is a cross-sectional diagrammatic view of another diathermal heater system having concentric electrodes, in accordance with the present invention.
Figure 3:
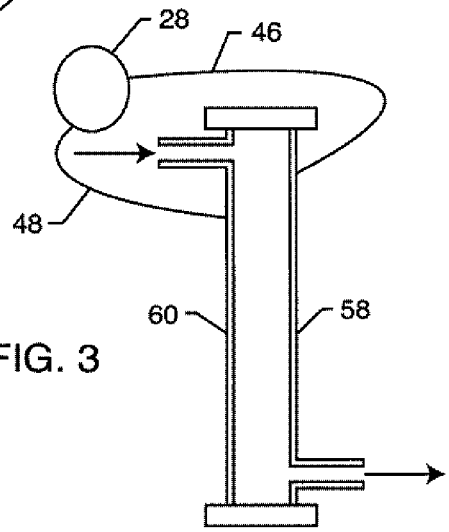
FIG. 3 is a cross-sectional diagrammatic view of yet another diathermal heating system having parallel electrodes, in accordance with the present invention.
Figure 4:
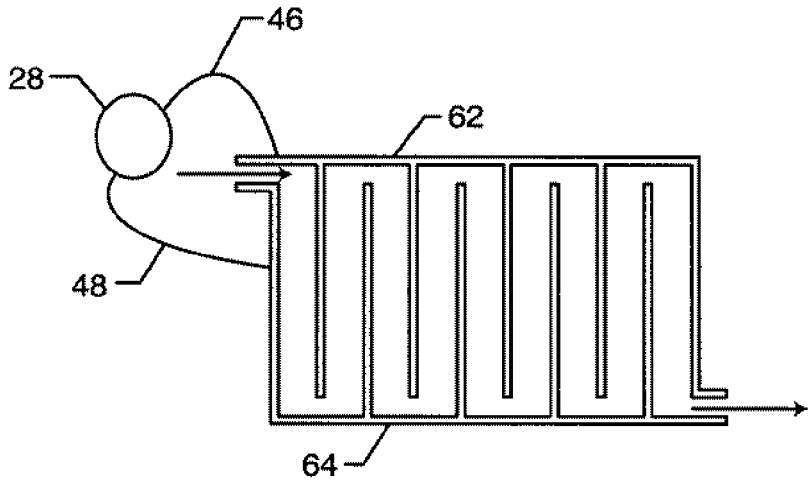
FIG. 4 is a cross-sectional diagrammatic view of another diathermal heater having an alternating array of electrodes, in accordance with the present invention.

With reference now to FIGS. 2-4, it will be appreciated by those skilled in the art that the electrode arrangement 12 and 14 is not limited to that illustrated in FIG. 1. As illustrated in FIG. 2, power may be passed through electrical components/circuitry 28 via leads 46 and 48 to concentric electrodes 50-56, the liquid passing between the electrodes 50-56 so as to have the electrical oscillations and current impinge thereupon and heat the liquid, as discussed above. FIG. 3 illustrates another heating chamber having parallel electrodes 58 and 60. FIG. 4 illustrates yet another heating chamber wherein the electrodes 62 and 64 form an alternating array of electrodes, such that the liquid is forced to pass therebetween while it is heated. Thus, it will be appreciated by those skilled in the art, that the arrangement of the electrodes is not critical, so long as the electrical oscillations and current can pass through the liquid and the liquid contains a sufficient level of dissolved solids so as to be efficiently heated.

Figure 5:
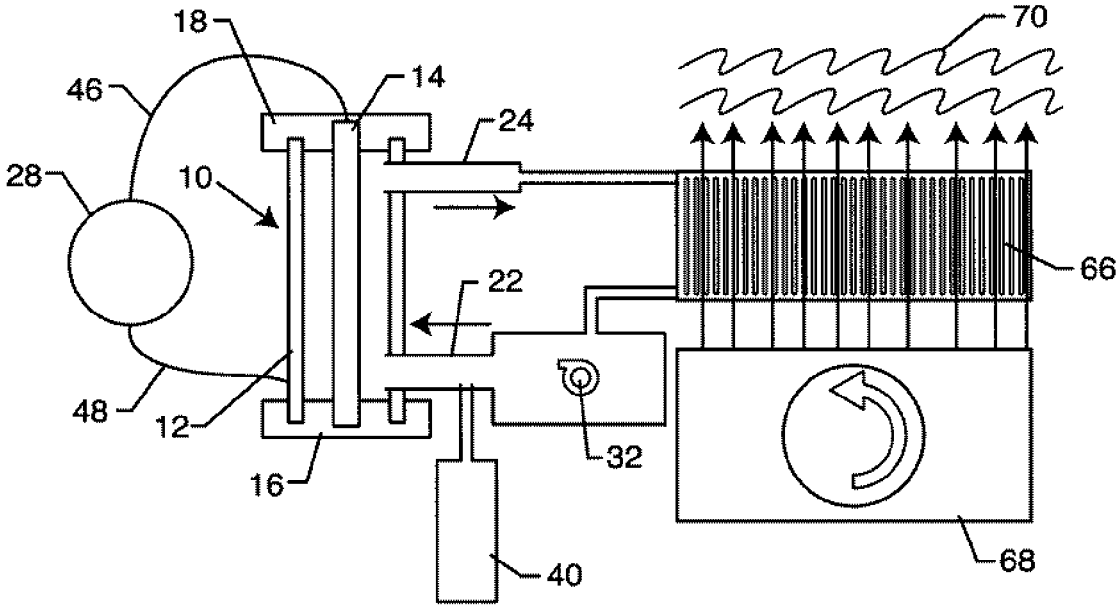
FIG. 5 is a closed loop diathermal heating system coupled to a heat exchanger, in accordance with the present invention.

With reference now to FIG. 5, a heating chamber 10 is illustrated, similar to that of FIG. 1, having a source of power 28 via electrical leads 46 and 48 to the spaced apart electrodes 12 and 14 to heat the liquid, as described above. In this case, the system is closed and the heated liquid is passed through outlet 24 and into a heat exchange device 66. In this case, the heat exchange device is a liquid-to-air heat exchanger having a high surface area, similar to a radiator. As the heated liquid passes therethrough, a fan 68 forces air over the heat exchange device 66, so as to heat the air 70. The embodiment illustrated in FIG. 5 can be used for space heaters, such as portable space heaters, heaters built into a structure, such as a house or commercial building and the like. The embodiment illustrated in FIG. 5 could also be used in association with hydronic systems, wherein the heated water is passed through duct work in a floor, walls, or even ceiling so as to heat the air which comes into contact with such structure. The cooled liquid is then recirculated by pump 32 into inlet 22 so as to be heated again by the heating chamber 10. The level of dissolved solids is periodically replenished, as discussed above, such as using a source of dissolved solids 40.

Figure 6:
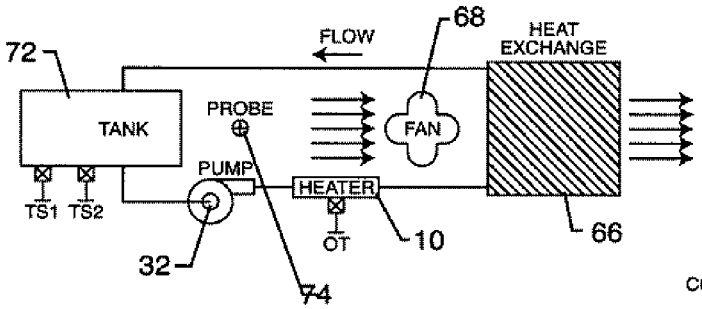
FIG. 6 is a diagrammatic view of a closed loop heating system incorporating a heat exchanger device, similar to FIG. 5.
Figure 7:
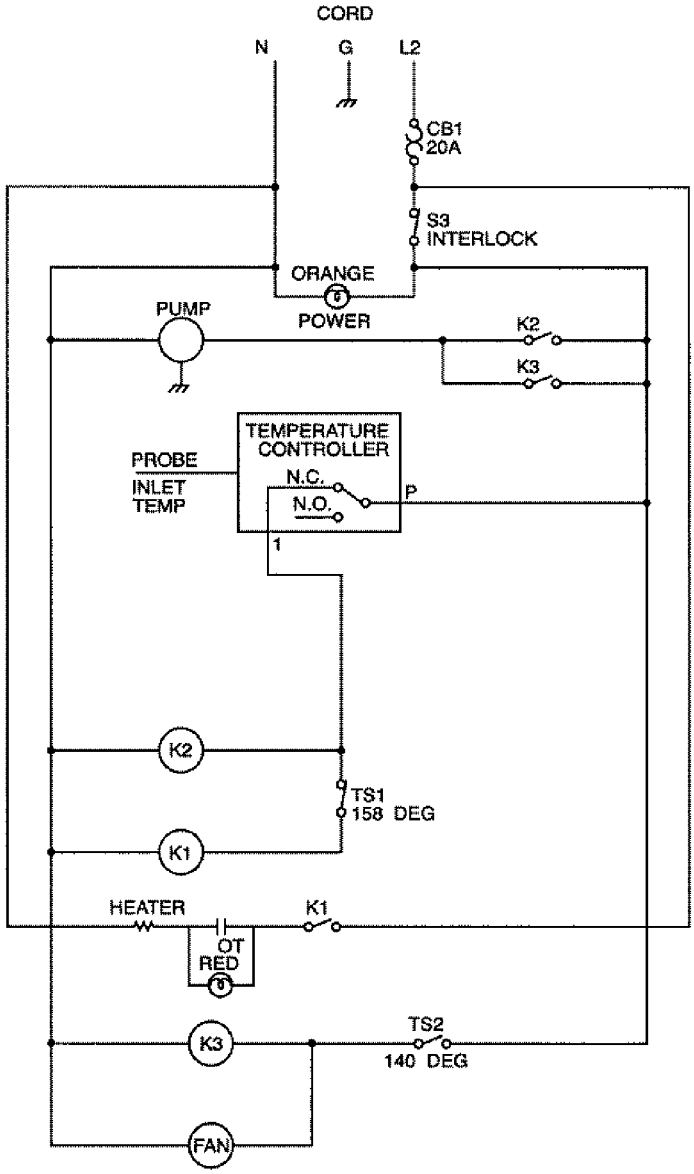
FIG. 7 is an electronic schematic illustrating power and control circuitry used in accordance with the heating system of FIG. 6.

With reference now to FIG. 6, another closed system is illustrated, wherein the pump 32 circulates water from a tank 72 through the heating chamber 10 and a heat exchanger 66. A fan or the like 68 forces air past the heat exchanger 66 so as to heat ambient air. A temperature probe 74 is used to monitor the temperature of the air or liquid. This embodiment is particularly adapted for portable heaters and in-wall heaters and the like which heat the ambient air in the space immediately in front of or surrounding the unit. With reference to FIG. 7, incoming power from the cords N, G, L2 is routed to at least one circuit breaker CB2. At least one interlock switch is preferably incorporated such that when the cover of the unit is removed, power to the control circuitry is disconnected. An indictor light can be incorporated to signify that the power is connected, as illustrated by the "orange power" or other color indicator light.

A temperature controller is used to adjust the amount of heat to be supplied by the unit to heat ambient air. Typically, the temperature controller has a range of 40 to 80 degrees Fahrenheit, or the target ambient temperature, and is the main user control mounted on the front panel, such as by a rotary dial or the like. When the controller is turned fully off, the controller will typically heat to protect the unit from damage from freezing. When the temperature drops below a set point, the red indicator light, an optional hour meter (not shown), and controller relay K2 are energized. Thermal switch TS1 is normally closed until the water temperature reaches a predetermined level, such as 150 degrees Fahrenheit. While it is closed, the heating element is energized and begins to heat the water. Controlled relay K2 turns on the pump to circulate the water from the storage tank, through the heater and through the heat exchanger. When the water reaches a predetermined level, such as 140 degrees Fahrenheit, the temperature switch TS2 turns on the fan 68 and energizes controlled relay K3. The unit is now in heating mode, with the heating chamber 10, circulating pump, and an all operating. Temperature switch TS1 controls the heating chamber electrodes, and maintains the water at a predetermined temperature, typically 158 degrees Fahrenheit.

When the air temperature reaches the desired temperature, as set by the temperature controller, which may be linked to a thermostat, the red indicator light, optional hour meter, and control relay K2 are de-energized. The pump 32 and fan 68 typically will remain on until the temperature switch TS1 opens as the water temperature falls below the preset level, typically 140 degrees Fahrenheit. At that time, the pump and fan are shut off and the unit is no longer providing heat. When the air temperature falls below the selected temperature, the system will again become energized and the water heated until the air temperature is raised to the desired level.

Although several embodiments have been described in detail for purposes of illustration, various modifications may be made to each without departing from the scope and spirit of the invention. Accordingly, the invention is not being limited, except as by the appended claims.

What is claimed is:

1. A method for heating a liquid, comprising the steps of:

providing a diathermal heating chamber having spaced apart electrodes;

passing a liquid having a predetermined minimum concentration of dissolved solids through the diathermal heating chamber;

supplying electrical power to the electrodes; and replenishing the dissolved solids as the concentration of dissolved solids in the liquid falls below a predetermined minimum level.

2. The method of claim 1, wherein the passing step comprises the step of passing the liquid within the space between the electrodes.

3. The method of claim 2, wherein the providing step includes the step of providing a diathermal heating chamber having concentric electrodes, parallel electrodes, or an alternating array of electrodes.

4. The method of claim 1, wherein the supplying step comprises the step of supplying a frequency of electrical oscillations to the electrodes.

5. The method of claim 4, wherein the supplying step comprises the step of supplying between 100 and 500 volts at approximately 60 Hz.

6. The method of claim 1, including the step of monitoring the concentration of dissolved solids in the liquid.

7. The method of claim 6, wherein the monitoring step includes the step of sensing or measuring the concentration of dissolved solids in the liquid.

8. The method of claim 6, wherein the monitoring step includes the step of monitoring an electrical current of the electrical oscillation input to the electrodes.

9. The method of claim 8, including the step of replenishing the dissolved solids when the electrical current input to the electrodes falls below a predetermined threshold level.

10. The method of claim 6, wherein the monitoring step includes the step of measuring the temperature of the liquid.

11. The method of claim 10, including the step of replenishing the dissolved solids when the measured liquid temperature falls below a predetermined threshold level.

12. The method of claim 1, including the step of pumping the heated liquid through a heat exchanger device so as to transfer heat from the liquid to another fluid.

13. The method of claim 12, including the step of monitoring the temperature of the fluid, and replenishing the dissolved solids when the temperature of the fluid falls below a predetermined level.

14. The method of claim 1, wherein the replenishing step comprises the step of adding a concentrate of dissolved solids or solids to be dissolved into the liquid.

15. The method of claim 1, wherein the replenishing step comprises the step of replacing at least a portion of the liquid with liquid having a minimum concentration of dissolved solids.

16. The method of claim 1, including the step of replenishing the dissolved solids after the liquid has been heated for a predetermined period of time.

17. The method of claim 6, including the step of controlling current input to the electrodes or liquid temperature when there is an excessive concentration of dissolved solids in the liquid.

18. The method of claim 17, wherein the supplying step comprises the step of supplying between 100 and 500 volts at a frequency to the electrodes.

19. The method of claim 17, wherein the monitoring step includes the step of sensing or measuring the concentration of dissolved solids in the liquid.

20. The method of claim 17, wherein the monitoring step includes the steps of monitoring an electrical current of the electrical oscillation input to the electrodes, and replenishing the dissolved solids when the electrical current input to the electrodes falls below a predetermined threshold level.

21. The method of claim 17, wherein the monitoring step includes the step of measuring the temperature of the liquid, and replenishing the dissolved solids when the measured liquid temperature falls below a predetermined threshold level.

22. The method of claim 17, including the step of pumping the heated liquid through a heat exchanger device so as to transfer heat from the liquid to another fluid.

23. The method of claim 21, including the step of monitoring the temperature of the fluid, and replenishing the dissolved solids when the temperature of the fluid falls below a predetermined level.

24. The method of claim 17, wherein the replenishing step comprises the step of adding a concentrate of dissolved solids or solids to be dissolved into the liquid.

25. The method of claim 17, wherein the replenishing step comprises the step of replacing at least a portion of the liquid with liquid having a minimum concentration of dissolved solids.

26. The method of claim 17, including the step of replenishing the dissolved solids after the liquid has been heated for a predetermined period of time.

27. A method for heating a liquid, comprising the steps of:

providing a diathermal heating chamber having spaced apart electrodes;

passing a liquid having a predetermined minimum concentration of dissolved solids between the electrodes of the diathermal heating chamber;

supplying electrical oscillations to the electrodes;

monitoring the concentration of dissolved solids in the liquid; and replenishing the dissolved solids as the concentration of dissolved solids in the liquid falls below a predetermined minimum level or reducing current supplied to the electrodes and/or reducing the liquid temperature if the concentration of dissolved solids in the liquid exceeds a predetermined maximum level.

* * * * *